US007395599B2

(12) United States Patent
Onion

(10) Patent No.: US 7,395,599 B2
(45) Date of Patent: Jul. 8, 2008

(54) BLADE-ASSISTING MECHANISM FOR A FOLDING KNIFE

(75) Inventor: Kenneth J. Onion, Kaneohe, HI (US)

(73) Assignee: KAI U.S.A., Ltd., Tualatin, OR (US)

( * ) Notice: Subject to any disclaimer, the term of this patent is extended or adjusted under 35 U.S.C. 154(b) by 169 days.

(21) Appl. No.: 10/993,206

(22) Filed: Nov. 18, 2004

(65) Prior Publication Data

US 2005/0132576 A1 Jun. 23, 2005

Related U.S. Application Data

(60) Provisional application No. 60/523,342, filed on Nov. 18, 2003.

(51) Int. Cl.
*B26B 1/02* (2006.01)

(52) U.S. Cl. ..... 30/159; 30/158

(58) Field of Classification Search ..... 30/158, 30/159, 160, 155, 156, 157, 330
See application file for complete search history.

(56) References Cited

U.S. PATENT DOCUMENTS

| | | | |
|---|---|---|---|
| 23,975 | A | 5/1859 | Belcher |
| 57,902 | A | 9/1866 | Hibbard |
| 226,910 | A | 4/1880 | Friebertshauser |
| 338,251 | A | 3/1886 | Crandall et al. |
| 382,967 | A | 5/1888 | Fullerton |
| 530,792 | A | 12/1894 | Nordlow |
| 551,052 | A | 12/1895 | Waldron et al. |
| 552,928 | A | 1/1896 | Russell |
| 557,760 | A | 4/1896 | Brauer |
| 577,593 | A | 2/1897 | Bronson et al. |
| 600,442 | A | 3/1898 | Nell |
| 616,689 | A | 12/1898 | Ruettgers |
| 749,230 | A | 1/1904 | Severance |
| 777,358 | A | 12/1904 | Weck |
| 825,976 | A | 7/1906 | Neiglick |
| 845,792 | A | 3/1907 | Jenkins |
| 969,909 | A | 9/1910 | Schrade et al. |
| 1,057,525 | A | 4/1913 | Bruecker |
| 1,189,005 | A | 6/1916 | Seely |

(Continued)

FOREIGN PATENT DOCUMENTS

| | | |
|---|---|---|
| DE | 29 469 | 6/1884 |

(Continued)

*Primary Examiner*—Hwei-Siu C. Payer
(74) *Attorney, Agent, or Firm*—Seed IP Law Group PLLC

(57) ABSTRACT

A folding knife is disclosed. The folding knife includes a handle; a blade connected to the handle in a manner allowing pivoting of the blade between a closed position in which the blade extends along the handle, and an open position in which the blade extends away from the handle; and a blade-assisting mechanism including a biasing assembly and a housing, wherein the biasing assembly is configured to urge the blade towards at least one of the open position and the closed position over at least a portion of the blade travel between the closed position and the open position, and the housing encloses at least a portion of the blade-assisting mechanism, and wherein the blade-assisting mechanism is configured to be removably mounted between the blade and the handle.

22 Claims, 4 Drawing Sheets

U.S. PATENT DOCUMENTS

| | | | | |
|---|---|---|---|---|
| 1,315,503 | A | 9/1919 | Hughes | |
| 1,315,901 | A * | 9/1919 | Ballinger | 30/159 |
| 1,319,532 | A | 10/1919 | Rasmussen | |
| 1,357,398 | A | 11/1920 | Haywood | |
| 1,412,373 | A | 4/1922 | Shields | |
| 1,417,872 | A | 5/1922 | Wall | |
| 1,440,793 | A | 1/1923 | Rasmussen | |
| 1,454,665 | A | 5/1923 | Bobek | |
| 1,496,188 | A | 6/1924 | Wall | |
| 1,515,688 | A | 11/1924 | Love | |
| 1,584,165 | A | 5/1926 | Brown | |
| 1,603,914 | A | 10/1926 | Hermann | |
| 1,614,949 | A | 1/1927 | Finley | |
| 1,701,027 | A | 2/1929 | Brown | |
| 1,738,496 | A | 12/1929 | Laux | |
| 1,743,022 | A | 1/1930 | Carman | |
| 1,810,031 | A | 6/1931 | Schrade | |
| 1,864,011 | A | 6/1932 | Brown | |
| 2,284,168 | A | 5/1942 | Rickenbacher | 30/162 |
| 2,286,524 | A | 6/1942 | Wilbur | 30/161 |
| D137,408 | S | 3/1944 | Frisk | |
| 2,407,897 | A | 9/1946 | Newman | 30/159 |
| 2,455,765 | A | 12/1948 | Harvey | 248/360 |
| 2,736,959 | A | 3/1956 | Simon et al. | 30/123 |
| 3,079,784 | A | 3/1963 | Pavioski | 70/456 |
| 3,404,456 | A | 10/1968 | Chilko | 30/155 |
| 3,868,774 | A | 3/1975 | Miori | 30/161 |
| 4,040,181 | A | 8/1977 | Johnson | 30/161 |
| 4,133,106 | A | 1/1979 | Addis | 30/160 |
| 4,148,140 | A | 4/1979 | Lile | 30/161 |
| 4,173,068 | A | 11/1979 | Cargill | 30/161 |
| 4,211,003 | A | 7/1980 | Collins | 30/162 |
| 4,218,819 | A | 8/1980 | Phelps | 30/157 |
| 4,240,201 | A | 12/1980 | Sawby et al. | 30/161 |
| 4,268,960 | A | 5/1981 | Reinschreiber | 30/161 |
| 4,274,200 | A | 6/1981 | Coder | 30/161 |
| 4,322,885 | A | 4/1982 | Osada | 30/162 |
| 4,347,665 | A | 9/1982 | Glesser | 30/161 |
| 4,356,631 | A | 11/1982 | Guth | 30/154 |
| 4,389,775 | A | 6/1983 | Collins | 30/156 |
| 4,404,748 | A | 9/1983 | Wiethoff | 30/161 |
| 4,426,779 | A | 1/1984 | Morgan | 30/138 |
| 4,439,922 | A | 4/1984 | Sassano | 30/161 |
| 4,442,600 | A | 4/1984 | Felix-Dalichow | 30/161 |
| 4,451,982 | A | 6/1984 | Collins | 30/161 |
| 4,466,561 | A | 8/1984 | Slaughter | 224/163 |
| 4,481,712 | A | 11/1984 | Phelps | 30/151 |
| 4,494,309 | A | 1/1985 | Gray | 30/151 |
| 4,494,310 | A | 1/1985 | Slaughter | 30/155 |
| 4,502,221 | A | 3/1985 | Pittman | 30/160 |
| 4,525,928 | A | 7/1985 | Foster | 30/158 |
| 4,529,111 | A | 7/1985 | Hayakawa | 224/163 |
| 4,541,175 | A | 9/1985 | Boyd et al. | 30/161 |
| 4,541,556 | A | 9/1985 | Collins et al. | 224/196 |
| 4,561,577 | A | 12/1985 | Moore | 224/232 |
| 4,563,833 | A | 1/1986 | Aucoin | 43/54.1 |
| 4,570,341 | A | 2/1986 | Konneker | 30/161 |
| 4,600,133 | A | 7/1986 | Maihos | 224/232 |
| 4,604,803 | A | 8/1986 | Sawby | 30/161 |
| 4,612,706 | A | 9/1986 | Yunes | 30/160 |
| 4,670,984 | A | 6/1987 | Rickard | 30/161 |
| 4,719,700 | A | 1/1988 | Taylor, Jr. | 30/158 |
| 4,741,106 | A | 5/1988 | Yamagishi | 30/161 |
| 4,776,094 | A | 10/1988 | Glesser | 30/160 |
| 4,802,279 | A | 2/1989 | Rowe | 30/155 |
| 4,805,303 | A | 2/1989 | Gibbs | 30/161 |
| 4,805,819 | A | 2/1989 | Collins | 224/232 |
| 4,811,486 | A | 3/1989 | Cunningham | 30/161 |
| 4,837,932 | A | 6/1989 | Elsener | 30/161 |
| 4,848,000 | A | 7/1989 | O'Dell | 30/158 |
| 4,893,409 | A | 1/1990 | Poehlmann | 30/161 |
| 4,896,424 | A | 1/1990 | Walker | 30/349 |
| 4,909,424 | A | 3/1990 | Reynolds | 224/232 |
| 4,947,552 | A | 8/1990 | Barnes | 30/161 |
| 4,974,323 | A | 12/1990 | Cassady | 30/155 |
| 4,979,301 | A | 12/1990 | Walker | 30/161 |
| 5,044,079 | A | 9/1991 | Gibbs | 30/160 |
| 5,060,379 | A | 10/1991 | Neely | 30/161 |
| 5,092,045 | A | 3/1992 | Boyd, Jr. et al. | 30/161 |
| 5,095,624 | A | 3/1992 | Ennis | 30/161 |
| 5,111,581 | A | 5/1992 | Collins | 30/161 |
| 5,123,167 | A | 6/1992 | Kelley | 30/151 |
| 5,131,149 | A | 7/1992 | Thompson et al. | 30/161 |
| D333,251 | S | 2/1993 | Glesser | D8/99 |
| D336,602 | S | 6/1993 | Thompson et al. | D8/99 |
| 5,217,150 | A | 6/1993 | Chen | 224/163 |
| 5,217,151 | A | 6/1993 | Parsons | 224/253 |
| D345,289 | S | 3/1994 | Sakai | D8/99 |
| 5,293,690 | A | 3/1994 | Cassady | 30/161 |
| D348,599 | S | 7/1994 | Sakai | D8/99 |
| 5,325,588 | A | 7/1994 | Rogers | 30/161 |
| 5,331,741 | A | 7/1994 | Taylor, Jr. | 30/158 |
| 5,349,753 | A | 9/1994 | Gaffney | 30/155 |
| 5,361,497 | A | 11/1994 | Crawford | 30/155 |
| 5,400,509 | A | 3/1995 | Collins | 30/161 |
| 5,425,175 | A | 6/1995 | Rogers | 30/161 |
| 5,437,101 | A | 8/1995 | Collins | 30/153 |
| 5,450,670 | A | 9/1995 | Sakai | 30/298.4 |
| 5,461,786 | A | 10/1995 | Miller | 30/161 |
| D366,408 | S | 1/1996 | Sessions et al. | D8/99 |
| 5,493,781 | A | 2/1996 | Saito | 30/162 |
| 5,502,895 | A | 4/1996 | Lemaire | 30/158 |
| 5,511,310 | A | 4/1996 | Sessions et al. | 30/161 |
| 5,511,311 | A | 4/1996 | Collins | 30/162 |
| 5,515,610 | A | 5/1996 | Levin et al. | 30/161 |
| 5,537,750 | A | 7/1996 | Seber et al. | 30/161 |
| 5,546,662 | A | 8/1996 | Seber et al. | 30/161 |
| D373,716 | S | 9/1996 | Keys et al. | D8/107 |
| 5,581,895 | A | 12/1996 | Jeffcoat | 30/294 |
| 5,596,808 | A | 1/1997 | Lake et al. | 30/161 |
| 5,615,484 | A | 4/1997 | Pittman | 30/161 |
| 5,647,129 | A | 7/1997 | Stamper | 30/139 |
| D385,173 | S | 10/1997 | McWillis | D8/99 |
| 5,685,079 | A | 11/1997 | Brothers et al. | 30/161 |
| 5,689,885 | A | 11/1997 | Walston | 30/160 |
| 5,692,304 | A | 12/1997 | Campbell | 30/161 |
| 5,699,615 | A | 12/1997 | Chen | 30/160 |
| D392,538 | S | 3/1998 | Buck et al. | D8/99 |
| D392,539 | S | 3/1998 | Balolia | D8/99 |
| 5,737,841 | A | 4/1998 | McHenry et al. | 30/161 |
| 5,755,035 | A | 5/1998 | Weatherly | 30/161 |
| 5,781,998 | A | 7/1998 | Stamper | 30/139 |
| 5,802,722 | A | 9/1998 | Maxey et al. | 30/160 |
| D399,113 | S | 10/1998 | Balolia | D8/99 |
| 5,815,927 | A | 10/1998 | Collins | 30/161 |
| 5,819,414 | A | 10/1998 | Marifone | 30/160 |
| 5,822,866 | A | 10/1998 | Pardue | 30/161 |
| 5,822,867 | A | 10/1998 | Sakai | 30/298.4 |
| 5,826,340 | A | 10/1998 | Hull | 30/161 |
| 5,839,194 | A | 11/1998 | Bezold | 30/161 |
| 5,845,404 | A | 12/1998 | Jeffcoat | 30/125 |
| D407,003 | S | 3/1999 | Macowski et al. | D8/99 |
| 5,875,552 | A | 3/1999 | Chen | 30/161 |
| 5,878,500 | A | 3/1999 | Emerson | 30/158 |
| 5,887,347 | A | 3/1999 | Gibbs | 30/161 |
| 5,964,036 | A | 10/1999 | Centofante | 30/161 |
| 5,966,816 | A | 10/1999 | Roberson | 30/156 |
| D422,479 | S | 4/2000 | Pardue | D8/99 |
| 6,079,106 | A | 6/2000 | Vallotton | 30/161 |
| 6,122,829 | A | 9/2000 | McHenry et al. | 30/161 |
| 6,125,543 | A | 10/2000 | Jhones | 30/161 |
| 6,145,202 | A | 11/2000 | Onion | 30/160 |
| D434,631 | S | 12/2000 | Lum | D8/99 |
| 6,154,965 | A | 12/2000 | Sakai | 30/161 |

| | | | | |
|---|---|---|---|---|
| 6,158,127 | A | 12/2000 | Taylor | 30/158 |
| D438,085 | S | 2/2001 | Onion | D8/99 |
| 6,256,888 | B1 | 7/2001 | Shuen | 30/161 |
| 6,276,063 | B1 | 8/2001 | Chen | 30/161 |
| 6,289,592 | B1 | 9/2001 | Emerson | 30/161 |
| 6,308,420 | B1 | 10/2001 | Moser | 30/161 |
| 6,338,431 | B1 | 1/2002 | Onion | 230/161 |
| 6,378,214 | B1 | 4/2002 | Onion | 30/161 |
| 6,397,476 | B1 | 6/2002 | Onion | 30/160 |
| 6,397,477 | B1 | 6/2002 | Collins | 30/161 |
| 6,427,334 | B2 | 8/2002 | Onion | 30/161 |
| 6,427,335 | B1 | 8/2002 | Ralph | 30/161 |
| 6,430,816 | B2 | 8/2002 | Neveux | 30/161 |
| 6,434,831 | B2 | 8/2002 | Chen | 30/161 |
| 6,438,848 | B1 | 8/2002 | McHenry et al. | 30/161 |
| D462,582 | S | 9/2002 | Parlowski | D7/649 |
| 6,442,843 | B1 | 9/2002 | Jue et al. | 30/151 |
| 6,490,797 | B1 | 12/2002 | Lake et al. | 30/161 |
| 6,553,671 | B2 | 4/2003 | Blanchard | 30/161 |
| 6,574,869 | B1 | 6/2003 | McHenry et al. | 30/161 |
| 6,591,504 | B2 | 7/2003 | Onion | 30/160 |
| 6,651,344 | B2 | 11/2003 | Cheng | 30/159 |
| 6,732,436 | B2 | 5/2004 | Moizis | 30/155 |
| D498,985 | S | 11/2004 | Kerr et al. | D7/649 |
| 6,810,588 | B1 * | 11/2004 | Cheng | 30/153 |
| 6,941,661 | B2 * | 9/2005 | Frazer | 30/160 |
| 2002/0000042 | A1 | 1/2002 | Glesser et al. | 30/160 |
| 2002/0157260 | A1 | 10/2002 | Cheng | 30/161 |
| 2003/0070299 | A1 | 4/2003 | Frazer | 30/161 |
| 2003/0089750 | A1 | 5/2003 | Martinez | 224/232 |
| 2003/0226260 | A1 * | 12/2003 | Sullivan | 30/160 |
| 2004/0020058 | A1 | 2/2004 | Vallotton | 30/160 |
| 2005/0097754 | A1 * | 5/2005 | Onion | 30/159 |

FOREIGN PATENT DOCUMENTS

| | | |
|---|---|---|
| EP | 0 230 000 | 7/1987 |
| FR | 493 741 | 8/1919 |
| FR | 1 069 862 | 7/1954 |
| FR | 1 171 740 | 1/1959 |
| FR | 1 248 117 | 10/1960 |
| FR | 2 705 606 | 12/1994 |
| JP | 3-227601 | 10/1991 |
| JP | 4-030979 | 2/1992 |

* cited by examiner

BLADE-ASSISTING MECHANISM FOR A FOLDING KNIFE

CROSS-REFERENCE TO RELATED APPLICATIONS

This application claims priority under 35 U.S.C. § 119(e) to U.S. Provisional Patent Application Ser. No. 60/523,342 entitled "Knife With Assisted Opening/Closing Cartridge," filed Nov. 18, 2003, the entire disclosure of which is herein incorporated by reference for all purposes.

TECHNICAL FIELD

The present disclosure relates generally to a folding knife, and particularly to a folding knife with a blade-assisting mechanism that urges the blade towards the open position and/or the closed position.

BACKGROUND

Folding knives enjoy wide popularity, particularly among sportsmen, campers, hikers, and many others engaged in outdoor activities. Common elements to folding knives include a handle and a blade pivotally connected to an end of the handle so that the blade pivots with respect to the handle between an open position in which the blade is extended away from the handle, and a closed position in which the blade is at least partially received within the handle. Many folding knives also include a blade-assisting mechanism that urges the blade towards the open position and/or the closed position.

Examples of folding knives, including folding knives with blade-assisting mechanisms, may be found in U.S. Pat. Nos. 551,052; 552,928; 557,760; 600,442; 1,315,503; 1,319,532; 1,412,373; 1,440,793; 1,603,914; 1,701,027; 1,743,022; 1,864,011; 2,736,959; 5,293,690; 5,815,927; 5,822,866; 5,802,722; 5,819,414; 6,145,202; 6,308,420; 6,338,431; 6,378,214; 6,397,477; 6,651,344; and 6,732,436; and U.S. Patent Aapplication Nos. 2003/0070299; 2004/0020058; and 2004/0158991, the entire disclosures of which are herein incorporated by reference for all purposes.

SUMMARY

One embodiment provides a folding knife. The folding knife includes a handle; a blade connected to the handle in a manner allowing pivoting of the blade between a closed position in which the blade extends along the handle, and an open position in which the blade extends away from the handle; and a blade-assisting mechanism including a biasing assembly and a housing, wherein the biasing assembly is configured to urge the blade towards at least one of the open position and the closed position over at least a portion of the blade travel between the closed position and the open position, and the housing encloses at least a portion of the blade-assisting mechanism, and wherein the blade-assisting mechanism is configured to be removably mounted between the blade and the handle.

DETAILED DESCRIPTION

Figure 1:
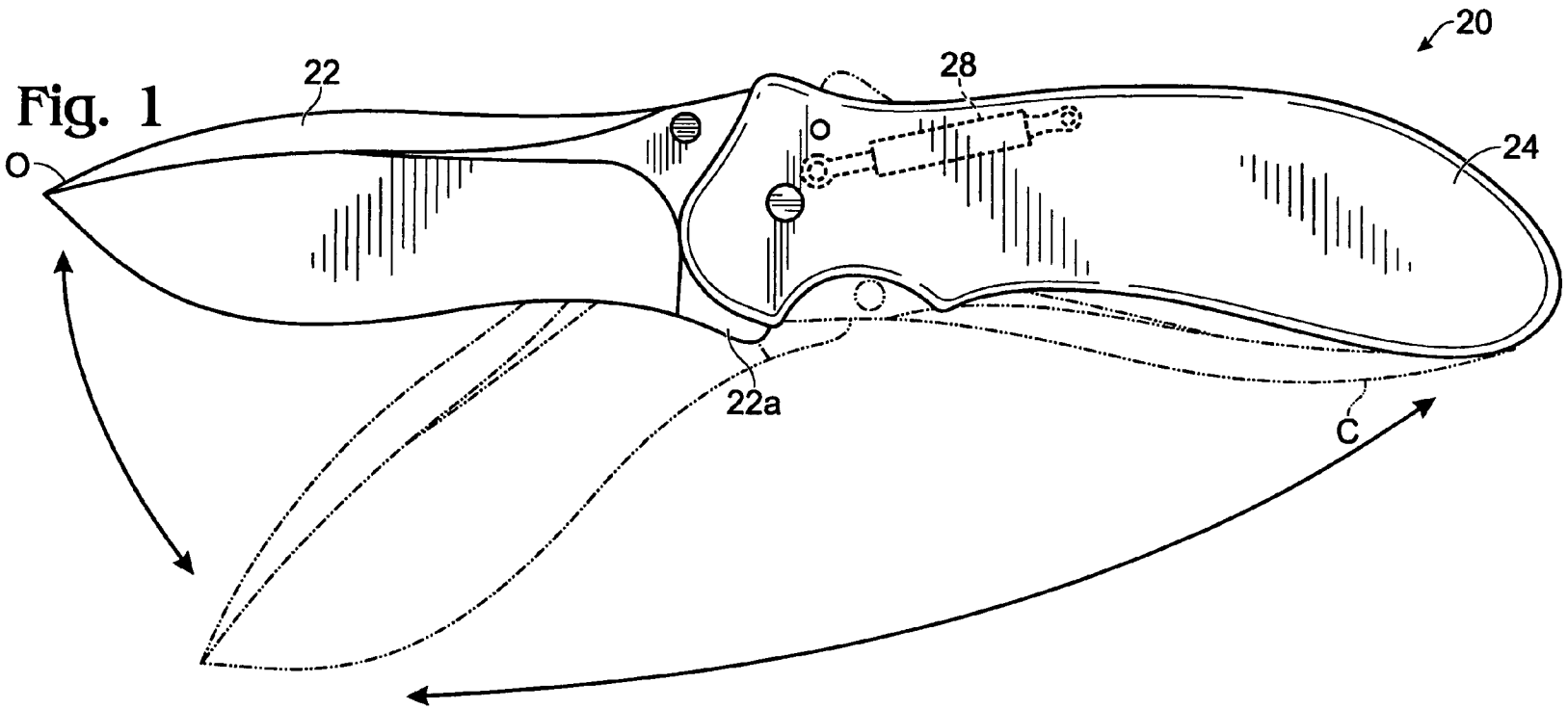
FIG. 1 is a side view of a folding knife incorporating an example of a blade-assisting mechanism.
Figure 2:
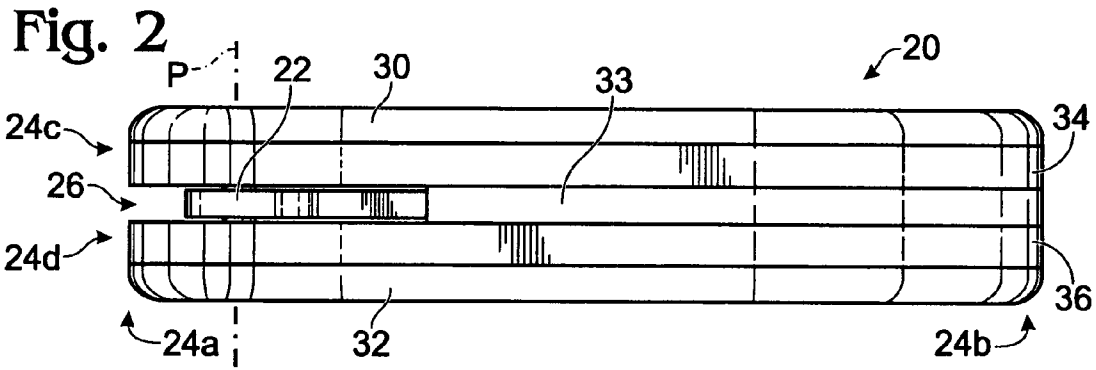
FIG. 2 is a front plan view of the folding knife of FIG. 1.

FIGS. 1-2 depict an embodiment of a folding knife 20 having a blade 22, a handle 24 defining a blade-receiving channel 26, and a blade-assisting mechanism 28. Blade 22 includes a tang 22*a* pivotally connected to handle 24. The blade pivots with respect to the handle about a pivot axis P between an open position O and a closed position C. In the open position, the blade extends away from the handle, where it is deployed and ready for use. From the open position, the blade may be folded towards the handle, pivoting about pivot axis P, into the closed position, in which the blade may be at least partially received for storage within blade-receiving channel 26. In the closed position, blade 22 extends along handle 24.

Handle 24 may include a pivot-end portion 24*a*, an opposing-end portion 24*b*, and first and second handle sides 24*c* and 24*d*. Tang 22*a* of blade 22 may be pivotally connected to handle 24 at pivot-end portion 24*a*. Handle sides 24*c* and 24*d* also may include respective handle side panels, such as opposite handle side panels 30 and 32. Handle side panels 30 and 32 may be any suitable shape or structure configured to facilitate gripping or handling of knife 20, including use of blade-assisting mechanism 28.

Additionally, handle sides 24*c* and 24*d* may include one or more handle liners, such as liners 34 and 36, which may be located between blade 22 and one or more of handle side panels 30 and 32. Handle side panels 30 and 32 may be any suitable shape or structure and may be configured to provide access to various components internal to handle 24.

Liners 34 and 36 may be any suitable shape or structure and may conform to the shape of handle side panels 30 and 32. The liners also may be configured to accommodate and/or support various components internal to handle 24. For example, one of liners 34 and 36 may include channel 37 to accommodate blade-assisting mechanism 28. Although the knife discussed and shown in FIGS. 1-2 includes two handle side panels and two liners, any combination of handle side panels and liners may be used.

Figure 3:
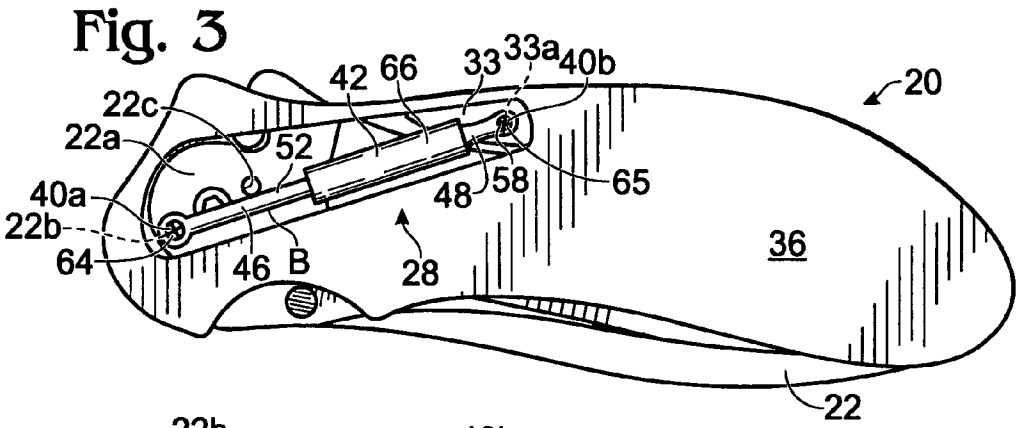
FIG. 3 is a side view of the folding knife of FIG. 1, shown without a handle side panel to illustrate the blade-assisting mechanism with the blade in the closed position.
Figure 4:
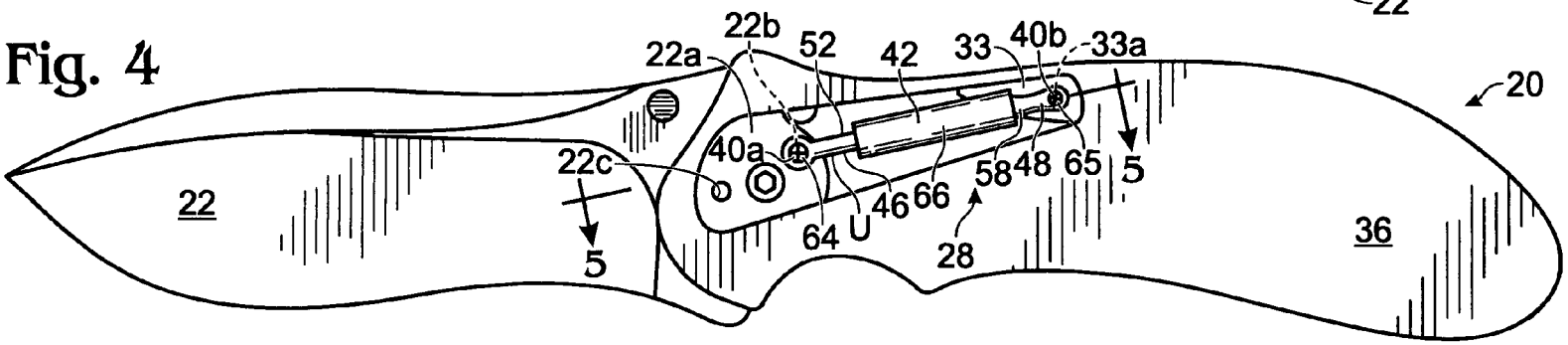
FIG. 4 is a side view of the folding knife of FIG. 1, shown without a handle side panel to illustrate the blade-assisting mechanism with the blade in the open position.
Figure 5:
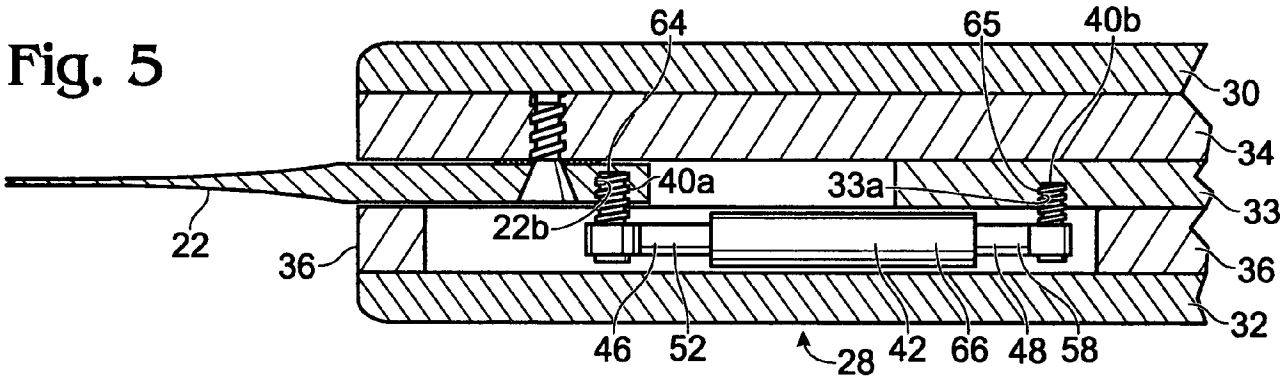
FIG. 5 is a cross-sectional view of the folding knife taken along lines 5-5 shown in FIG. 4 illustrating the blade-assisting mechanism connections to the blade and to the handle.

Blade-assisting mechanism 28 may include a biasing assembly 38, one or more mounting elements 40, and a housing 42, as shown in FIGS. 3-4. Biasing assembly 38 may include any structure configured to apply a biasing force F to urge blade 22 towards the open position and/or the closed position and to allow a user to easily remove and/or replace the blade-assisting mechanism. For example, as shown in FIGS. 3-6, biasing assembly 38 may include a bias element 44, a blade connector element 46, and a handle connector element 48. Biasing assembly 38 may move between a biased position B in which the bias assembly may urge the blade towards the open position and/or the closed position, and an unbiased position U in which the bias assembly may not urge the blade towards the open position and/or the closed position. Depending upon the configuration of the bias assembly, the biased and unbiased positions may be reversed.

Figure 6:
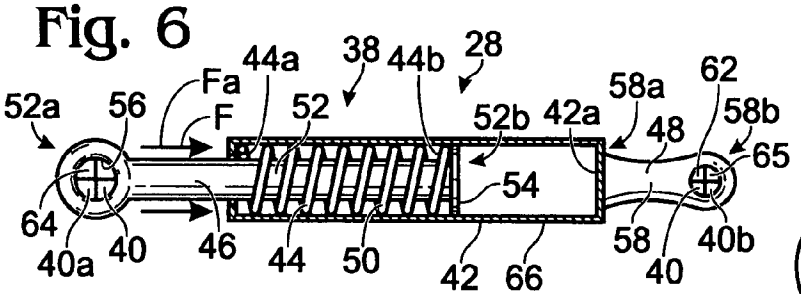
FIG. 6 is a side view of the blade-assisting mechanism of the folding knife of FIG. 1, shown without a portion of the housing to illustrate the components of the blade-assisting mechanism.

Bias element 44 may include any structure configured to apply biasing force F to urge blade 22 towards the open position and/or the closed position. For example, bias element 44 may be in the form of a coiled spring 50, as shown in FIG. 6. The bias element may include a first end 44*a* and a second end 44*b*. Additionally, bias element 44 may be configured to provide biasing force F in any suitable direction. For example, bias element 44 in FIGS. 3-4 provides a biasing force Fa in a "pulling direction" or from pivot end 24*a* of handle 24 toward opposing end 24*b*. Alternatively, bias element 44 may be configured to provide a biasing force Fb in a "pushing direction" or from opposing end 24*b* toward pivot end 24*a*, as further discussed below and in FIGS. 7-9. Moreover, other suitable directions may be used for biasing force F. Additionally, bias element 44 may apply biasing force F constantly, or may apply the biasing force over limited portions of blade travel.

Although bias element 44 is depicted as a coiled spring, it may be of any other suitable type of bias element configured to apply biasing force F to urge blade 22 towards the open position and/or the closed position, such as wire springs, leaf springs, piano wires, or other resilient material or structure. Additionally, bias element 44 may be configured to be adjustable to adjust the biasing force F, including adjusting the biasing force to zero.

Blade connector element 46 may include any structure operatively connecting bias element 44 and blade 22. For example, the connector element may include a first rod 52, as shown in FIG. 6. The first rod may be made of any suitable material. Optionally, biasing force F may be provided only by a resilient rod or other structure, without the use of separate bias element 44.

First rod 52 may include a first end portion 52*a* and a second end portion 52*b*. Second end portion 52*b* may have any suitable shape or structure configured to operatively connect that portion to second end 44*b* of bias element 44, such as a flange 54. First end portion 52*a* may have any suitable shape or structure configured to operatively connect that portion to blade 22, such as eyelet 56.

Although the first and second end portions of first rod 52 are shown to include flange 54 and eyelet 56, respectively, any suitable shape or structure may be used, such as latches or posts, or mechanical, magnetic, or electronic devices, configured to operatively connect first rod 52 to bias element 44 and/or blade 22. Moreover, although the first and second end portions of first rod 52 include different shapes or structures, the same shape or structure may be used for the end portions.

Handle connector element 48 may include any structure configured to operatively connect bias element 44 and handle 24. For example, the connector element may include a second rod 58, as shown in FIG. 6. The second rod 58 may be made of any suitable material. As mentioned above, biasing force F may optionally be provided only by a resilient rod or other structure, without the use of separate bias element 44.

Second rod 58 may include a first end portion 58*a* and a second end portion 58*b*. First end portion 58*a* may be connected to an end 42*a* of housing 42. Alternatively, or additionally, the first end portion may be connected to second end 44*b* of bias element 44. Second end portion 58*b* may have any suitable shape or structure configured to operatively connect that portion to handle 24, such as eyelet 62.

Although the second end portion of second rod 58 is shown to include eyelet 62, any suitable shape or structure may be used, such as latches or posts, or mechanical, magnetic, or electronic devices, configured to operatively connect second rod 58 to handle 24. Moreover, although bias element 44 is shown to be operatively connected to blade 22 and/or handle 24 via blade connector element 46 and handle connector element 48, those connector elements are not required and the bias element may be directly or indirectly connected to blade 22 and/or handle 24 without one or both of the connector elements. For example, second end 44*b* of bias element 44 may be directly connected to handle 24 without handle connector element 48.

"Operatively connecting," "operatively connect," "operatively connected," or "operative connection," as used herein, refers to a connector element being directly and/or indirectly connected to a bias element, to a blade, and/or to a handle in a manner that allows the bias element to apply biasing force F to urge the blade towards the open position and/or the closed position. For example, blade connector element 46 may be directly connected to bias element 44 but indirectly connected to blade 22, such as by contacting a post or any other structure on the blade. Additionally, the operative connection made by the connector element may be throughout the pivoting of the blade or may be during only part of the pivoting of that blade. For example, the blade connector element may contact the blade or a post on the blade only between the blade's closed position and an intermediate blade position.

Blade-assisting mechanism 28 also may include one or more mounting elements 40, such as first mounting element 40*a* and second mounting element 40*b*, which include any structure that allows the user to easily remove and/or replace blade-assisting mechanism 28. First mounting element 40*a* includes any structure configured to removably couple blade connector element 46 directly or indirectly to blade 22. For example, the first mounting element may include one or more screws 64 that are removably received in a first hole 22*b* of blade 22, as shown in FIGS. 3-4.

Additionally, screws 64 may be removably received in a second hole 22*c* of blade 22. The first and second holes allow a user to change the location of the operative connection to blade 22. That adjustability may allow the user to replace a blade-assisting mechanism that provides a biasing force in the "pulling" direction with a blade-assisting mechanism that provides a biasing force in the "pushing" direction, as further discussed below. Additional holes in the blade may be provided for more adjustability.

Second mounting element 40*b* includes any structure configured to removably couple handle connector element 48 directly or indirectly to handle 24. For example, the second mounting elements may include one or more screws 65 that are removably received in a hole 33*a* of a spacer 33 in handle 24.

Although the first and second mounting elements are shown as screws 64 and 65, any suitable structure may be used configured to removably couple the blade-assisting mechanism to the blade and/or to the handle. Additionally, although only two mounting elements are shown, any suitable number of mounting elements may be used to removably couple the blade-assisting mechanism to the blade and/or to the handle. Moreover, although the first and second mounting elements are shown to be removably received in holes 22*b* or 22*c*, and hole 33*a*, respectively, those elements may be removably received by any suitable structure associated with the blade and/or the handle. For example, first mounting element 40*a* may be removably received by a post or other structure located on blade 22.

Blade-assisting mechanism 28 also may include housing 42, which may include any structure configured to enclose at least a portion of biasing assembly 38 and/or to allow a user to easily remove and/or install biasing assembly 38 without the need to disassemble the biasing assembly. For example, as shown in FIG. 6, housing 42 may include shell 66. Shell 66 may partially or completely enclose the various components of biasing assembly 38, such as enclosing bias element 44 and partially enclosing blade connector element 46.

Blade connector element 46 may be variably enclosed by shell 66 as biasing assembly 38 moves between the biased position and the unbiased position. For example, as shown in FIGS. 3-4, blade connector element 46 may be substantially enclosed by the shell when the biasing assembly is in unbiased position U, and substantially external to the housing when the biasing assembly is in biased position B, or vice-versa. Additionally, or alternatively, handle connector element 48 may be variably enclosed by shell 66 as biasing assembly 38 moves between the biased position and the unbiased position.

Although blade-assisting mechanism 28 is shown to include the elements in FIGS. 3-6, any suitable structure may be used, configured to apply biasing force F to blade 22 to urge that blade towards the open position and/or the closed position, including the blade-assisting mechanisms of the patents and patent applications incorporated by reference. For example, bias element 44 may be in the form of a fluid confined in housing 42 where blade-assisting mechanism 28 works like a pneumatic cylinder. Additionally, although blade-assisting mechanism 28 is shown to be mostly located within handle 24, at least part of the blade-assisting mechanism may be accessible from outside handle 24 and/or may be external to handle 24.

Figure 7:
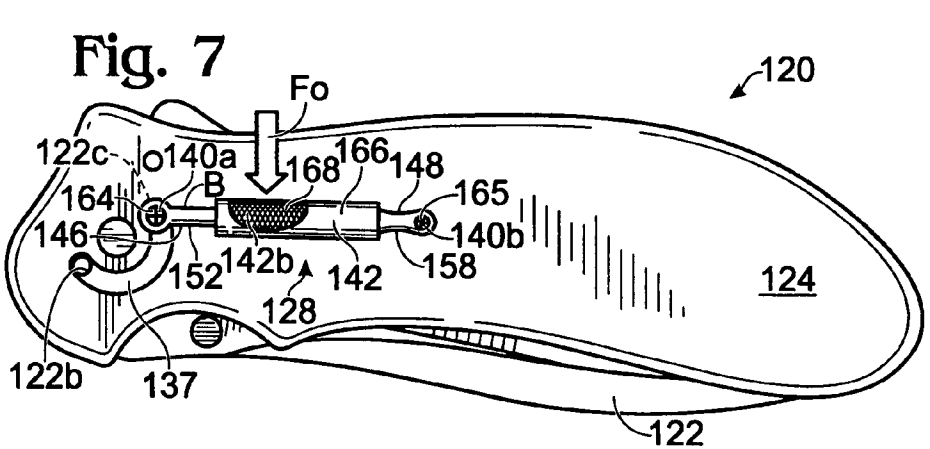
FIG. 7 is a side view of another example of a folding knife with a blade-assisting mechanism and the blade in the closed position.
Figure 8:
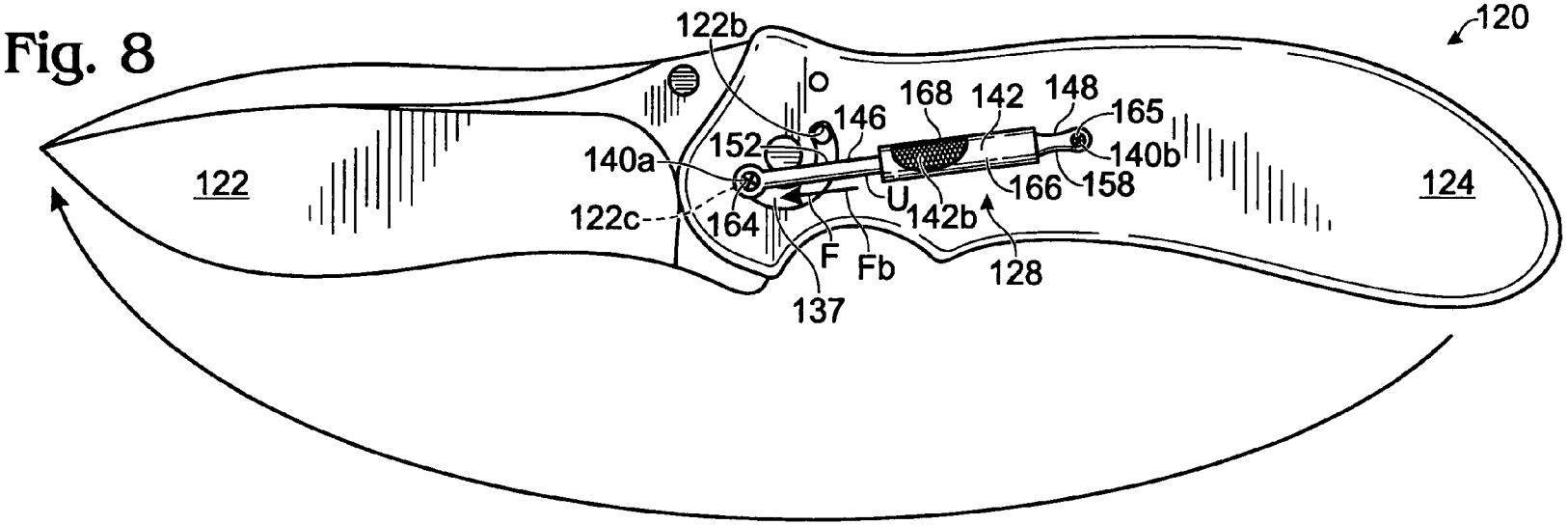
FIG. 8 is a side view of the folding knife of FIG. 7 with the blade in the open position.
Figure 9:
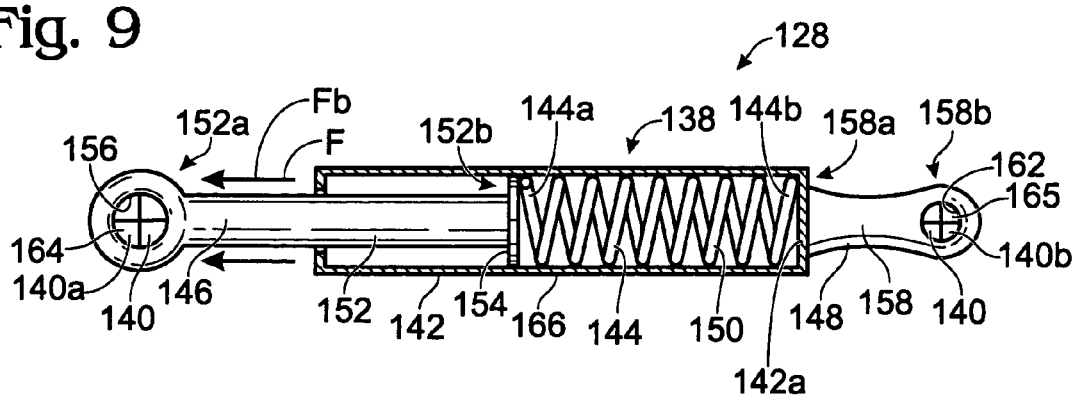
FIG. 9 is a side view of the blade-assisting mechanism of the folding knife of FIG. 7, shown without a portion of the housing to illustrate the components of the blade-assisting mechanism.

An alternative embodiment of folding knife 20 is shown in FIGS. 7-9 and generally indicated at 120. Unless otherwise specified, folding knife 120 may selectively include any of the elements, subelements, and variations as the other folding knives illustrated, described, or incorporated herein. Similar to the previously discussed embodiment, folding knife 120 includes a blade 122, a handle 124 including a blade-receiving channel 126 and an arcuate groove 137, and a blade-assisting mechanism 128.

Blade-assisting mechanism 128 may include a biasing assembly 138, one or more mounting elements 140, and a housing 142. Biasing assembly 138 includes any structure configured to apply a biasing force F to urge blade 122 towards the open position and/or the closed position and to allow a user to easily remove and/or replace the blade-assisting mechanism. For example, as shown in FIGS. 7-9, biasing assembly 138 may include a bias element 144, a blade connector element 146, and a handle connector element 148. Biasing assembly 138 may move between a biased position B in which the bias assembly urges the blade towards the open position and/or the closed position, and an unbiased position U in which the bias assembly does not urge the blade towards the open position and/or the closed position.

Bias element 144 may include any suitable structure configured to provide biasing force Fb in a "pushing direction." For example, bias element 144 may be in the form of a coiled spring 150 or other resilient structure or material described above configured to provide biasing force Fb. Additionally, bias element 144 may be configured to be adjustable to adjust the biasing force F, including adjusting the biasing force to zero.

Blade connector element 146 may include any suitable structure configured to operatively connect bias element 144 and blade 122. For example, blade connector element 146 may be in the form of a rod 152. The rod may be made of any suitable material. Rod 152 may include a first end portion 152*a* and a second end portion 152*b* as shown in FIG. 9. Second end portion 152*b* may have any suitable shape or structure configured to operatively connect to bias element 144, such as flange 154. First end portion 152*a* may have any suitable shape or structure configured to operatively connect that portion to blade 122, such as eyelet 156.

Although the first and second end portions of rod 152 are shown to include flange 154 and eyelet 156, respectively, any suitable shape or structure may be used, such as latches or posts, or mechanical, magnetic, or electronic devices, configured to operatively connect push rod 152 to bias element 144 and/or blade 122. Moreover, although the first and second end portions of push rod 152 include different shapes or structures, the same shape or structure may be used for the end portions. Furthermore, although blade-assisting mechanism 128 is configured to apply biasing force Fb in the pushing direction, the blade-assisting mechanism may be configured to apply biasing force Fa in the pulling direction, or any other biasing forces in any suitable directions.

Handle connector element 148 may include any structure operatively connecting bias element 144 and handle 124. For example, the connector element may include a second rod 158, as shown in FIG. 9. The second rod 158 may be made of any suitable material. Second rod 158 may include a first end portion 158*a* and a second end portion 158*b*. First end portion 158*a* may be connected to an end 142*a* of housing 142. Second end portion 158*b* may have any suitable shape or structure configured to operatively connect that portion to handle 124, such as eyelet 162.

Although the second end portion of second rod 158 is shown to include eyelet 162, any suitable shape or structure may be used, such as latches or posts, or mechanical, magnetic, or electronic devices, configured to operatively connect second rod 158 to bias element 142 and/or handle 124. Moreover, although bias element 144 is shown to be operatively connected to blade 122 and/or handle 124 via blade connector element 146 and handle connector element 148, those connector elements are not required and the bias element may be directly or indirectly connected to blade 122 and/or handle 124 without one or both of the connector elements. For example, second end 144*b* of bias element 144 may be directly connected to handle 124 without handle connector element 148.

Blade-assisting mechanism 128 also may include one or more mounting elements 140, such a first mounting element 140*a* and second mounting element 140*b*, which include any structure that allows the user to easily remove and/or replace blade-assisting mechanism 128. First mounting element 140*a* includes any structure configured to removably couple blade connector element 146 directly or indirectly to blade 122. For example, the first mounting element may include one or more screws 164 that are removably received in a first hole 122*b* of blade 122, as shown in FIGS. 7-8.

Additionally, screws 164 may be removably received in a second hole 122*c* of blade 122. The first and second holes allow a user to change the location of the operative connection to blade 122. That adjustability may allow the user to replace a blade-assisting mechanism that provides a biasing force in the "pulling" direction with a blade-assisting mechanism that provides a biasing force in the "pushing" direction, as further discussed below. Additional holes may be provided on the blade for more adjustability.

Second mounting element 140*b* includes any structure configured to removably couple handle connector element 148 directly or indirectly to handle 124. For example, the second mounting elements may include one or more screws 165 that are removably received in handle 24. Although the first and second mounting elements are shown as screws 164 and 165, any suitable structure may be used configured to removably couple the blade-assisting mechanism to the blade and/or to the handle. Additionally, although only two mounting elements are shown, any suitable number of mounting elements may be used to removably couple the blade-assisting mechanism to the blade and/or to the handle. Moreover, although the first and second mounting elements are shown to be removably received in holes 122*b* or 122*c*, and in the handle, respectively, those elements may be removably received by any suitable structure associated with the blade and/or the handle. For example, first mounting element 140*a* may be removably received by a post or other structure located on blade 122.

Blade-assisting mechanism 128 also may include housing 142, which may include any structure configured to enclose at least a portion of biasing assembly 138 and/or to allow a user to easily remove and/or install biasing assembly 138 without the need to disassemble the biasing assembly. For example, as shown in FIGS. 7-9, housing 142 may include shell 166. Shell 166 may partially or completely enclose the various components of biasing assembly 138, such as enclosing bias element 144 and partially enclosing blade connector element 146.

Blade connector element 146 may be variably enclosed by shell 166 as biasing assembly 138 moves between the biased position and the unbiased position. For example, as shown in FIGS. 7-8, blade connector element 146 may be substantially enclosed by the shell when the biasing assembly is in biased position B, and substantially external to the housing when the biasing assembly is in unbiased position U, or vice-versa. Additionally, or alternatively, handle connector element 148 may be variably enclosed by shell 166 as biasing assembly 138 moves between the biased position and the unbiased position.

Housing 142 also may include a gripping portion 142*b* which may include any suitable shape or structure configured to allow housing 142 to be manipulated from outside handle 124 to pivot the blade towards the open position and/or the closed position. For example, gripping portion 142*b* may include gripping ridges 168 or other suitable surface texture or structure.

Although blade-assisting mechanism 128 is shown to include the elements in FIG. 9, any suitable structure may be used, configured to apply biasing force F to blade 122 to urge that blade towards the open position and/or the closed position, including the blade-assisting mechanisms of the patents and patent applications incorporated by reference. For example, bias element 144 may be in the form of a fluid confined in housing 142 where blade-assisting mechanism 128 works like a pneumatic cylinder. Additionally, although blade-assisting mechanism 128 is shown to be external to handle 124, at least part of the blade-assisting mechanism may be internal to handle 124. Moreover, although the adjustable blade-assisting mechanisms are shown to be used in folding knives with pivoting blades, the adjustable blade-assisting mechanisms disclosed may be used for folding knives with other types of moving blades that are configured to move between the open position and the closed position.

Figure 10:
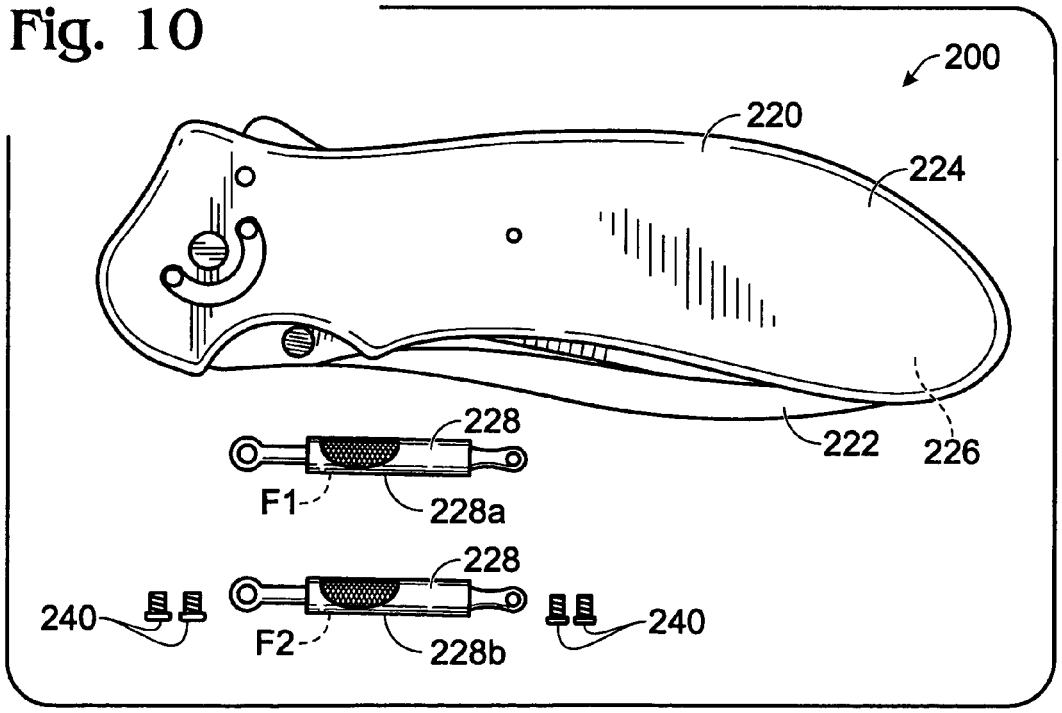
FIG. 10 is a side view of a folding knife kit including a folding knife and two blade-assisting mechanisms.

An alternative embodiment of folding knife 20, generally indicated at 220, may be packaged in a kit 200 to include one or more blade-assisting mechanisms 228 having one or more mounting elements 240, as shown in FIG. 10. The folding knife kit also may include additional suitable items, such as tools for the mounting elements, lubricants, etc.

Unless otherwise specified, folding knife 220 may selectively include any or all of the elements, subelements, and variations as the other folding knives illustrated, described, or incorporated herein. Similar to the previously discussed embodiment, folding knife 220 includes a blade 222 and a handle 224 having a blade-receiving channel 226. Blade-assisting mechanisms 228 may include components similar to the previously described blade-assisting mechanisms and/or the blade-assisting mechanisms of the patents and patent applications incorporated by reference.

Blade-assisting mechanisms 228 may include a first blade-assisting mechanism 228*a* and a second blade-assisting mechanism 228*b*. First blade-assisting mechanism 228*a* may be configured to apply a first biasing force $F_1$ to urge blade 222 towards the open position and/or the closed position, and second blade-assisting mechanism 228*b* may be configured to apply a second biasing force $F_2$ to urge blade 222 towards the open position and/or the closed position. Those mechanisms may be configured to perform similar and/or different functions. For example, first biasing force $F_1$ may be a greater, equal, or lesser force than second biasing force $F_2$. Additionally, or alternatively, first biasing force $F_1$ may urge the blade towards the open position, while second biasing force $F_2$ may urge the blade towards the closed position, or vice-versa. Additionally, or alternatively, first biasing force $F_1$ may be in a "pulling" direction, while second biasing force $F_2$ may be in a "pushing" direction, or vice-versa.

Although the folding knives and features of folding knives has been shown and described with reference to the foregoing operational principles and preferred embodiments, those skilled in the art will find apparent that various changes in form and detail may be made without departing from the spirit and scope of the claims. The present disclosure is intended to embrace all such alternatives, modifications, and variances that fall within the scope of the appended claims.

I claim:

1. A folding knife, comprising:

a handle;

a blade connected to the handle in a manner allowing pivoting of the blade between a closed position in which the blade extends along the handle, and an open position in which the blade extends away from the handle; and a blade-assisting mechanism including a biasing assembly and a housing, wherein the biasing assembly is configured to urge the blade towards at least one of the open position and the closed position over at least a portion of the blade travel between the closed position and the open position the housing enclosing the biasing assembly; and a plurality of pivot connectors that pivotally couple the blade-assisting mechanism between the blade and the handle.

2. The folding knife of claim 1, wherein the pivot connectors are accessible from outside the handle.

3. The folding knife of claim 2, wherein the blade-assisting mechanism is external to the handle.

4. The folding knife of claim 1, wherein the biasing assembly includes a bias element.

5. The folding knife of claim 4, wherein the bias element includes a coiled spring.

6. The folding knife of claim 1, wherein the biasing assembly is movable between a biased position in which the biasing assembly urges the blade towards the open position over at least a portion of the blade travel between the closed position and the open position, and an unbiased position in which the biasing assembly does not urge the blade towards the open position.

7. The folding knife of claim 6, wherein at least one of the pivot connectors is at least substantially enclosed by the housing when the biasing assembly is in one of the biased position and the unbiased position, and is at least substantially external to the housing when the biasing assembly is in the other position.

8. The folding knife of claim 7, wherein the at least one pivot connector is at least substantially enclosed by the housing when the biasing assembly is in the unbiased position, and is at least substantially external to the housing when the biasing assembly is in the biased position.

9. The folding knife of claim 7, wherein the at least one pivot connector is at least substantially enclosed by the housing when the biasing assembly is in the biased position, and is at least substantially external to the housing when the biasing assembly is in the unbiased position.

10. The folding knife of claim 1, wherein the biasing assembly is configured to urge the blade towards the closed position over a first portion of blade travel and to urge the blade towards the open position during a second portion of blade travel.

11. The folding knife of claim 1, wherein the blade-assisting mechanism is internal to the handle.

12. A folding knife, comprising:

a handle having an inner portion and an outer portion;

a blade connected to the handle in a manner allowing pivoting of the blade between a closed position in which the blade extends along the inner portion of the handle, and an open position in which the blade extends away from the handle; and a housing;

a first mounting element configured to pivotally couple the housing to the blade, a second mounting element configured to pivotally couple the housing to the handle; and a biasing assembly within the housing configured to apply a force between the first and second mounting elements that urges the blade towards at least one of the open position and the closed position over at least a portion of the blade travel between the open position and the closed position.

13. The folding knife of claim 12, wherein the biasing assembly is positioned outside the handle and located to be manipulable from outside the handle to move the blade towards at least one of the open position and the closed position.

14. The folding knife of claim 12, wherein at least one of the first mounting element and the second mounting element includes a screw about which the housing is able to pivot.

15. A folding knife, comprising:

a handle;

a blade connected to the handle in a manner allowing pivoting of the blade between a closed position and an open position; and a blade-assisting mechanism including a first mounting element configured to be removably coupled to the blade, a second mounting element configured to be removably coupled to the handle, and a biasing assembly operatively coupled between the first and second mounting elements to apply a force that urges the blade towards at least one of the open position and the closed position over at least a portion of the blade travel between the open position and the closed position, the blade-assisting mechanism being external to the handle.

16. The folding knife of claim 15, wherein the biasing assembly includes a coiled spring.

17. The folding knife of claim 15, wherein the blade-assisting mechanism comprises a housing positioned outside the handle and configured to be manipulable from outside the handle to move the blade towards at least one of the open position and the closed position.

18. A folding knife kit, comprising:

a folding knife having a handle and a blade, the blade being connected to the handle in a manner allowing movement of the blade between a closed position in which the blade extends along the handle, and an open position in which the blade extends away from the handle, the blade having a recess therein;

a plurality of housings, each housing having a respective one of a plurality of biasing assemblies enclosed therein and each housing configured to be removably mounted between the handle and the blade, the biasing assembly of each housing being configured to urge the blade towards at least one of the open position and the closed position over at least a portion of the blade travel between the open position and the closed position, each housing having an aperture; and at least one pivot connector that is sized to extend through the aperture of the housing and into the recess of the blade to pivotally couple the housing to the blade.

19. The folding knife kit of claim 18, wherein the plurality of biasing assemblies includes a first biasing assembly configured to apply a first biasing force to urge the blade towards at least one of the open position and the closed position, and a second biasing assembly configured to apply a second biasing force to urge the blade towards at least one of the open position and the closed position.

20. The folding knife kit of claim 19, wherein the first biasing force is different from the second biasing force.

21. The folding knife kit of claim 18, wherein the plurality of biasing assembly includes a first biasing assembly configured to apply a first biasing force to urge the blade towards the open position, and a second biasing assembly configured to apply a second biasing force to urge the blade towards the closed position.

22. The folding knife kit of claim 21, wherein the first biasing force is different from the second biasing force.

* * * * *